US010001259B2

(12) United States Patent
Pelejo et al.

(10) Patent No.: US 10,001,259 B2
(45) Date of Patent: Jun. 19, 2018

(54) METHODS FOR UNIFORM LED LIGHTING

(71) Applicants: Ricardo A. Pelejo, Surrey (CA); Michael A. Tischler, Vancouver (CA)

(72) Inventors: Ricardo A. Pelejo, Surrey (CA); Michael A. Tischler, Vancouver (CA)

(73) Assignee: COOLEDGE LIGHTING INC., Richmond, British Columbia (CA)

( * ) Notice: Subject to any disclaimer, the term of this patent is extended or adjusted under 35 U.S.C. 154(b) by 152 days.

(21) Appl. No.: 14/988,120

(22) Filed: Jan. 5, 2016

(65) Prior Publication Data

US 2016/0195251 A1 Jul. 7, 2016

Related U.S. Application Data

(60) Provisional application No. 62/100,265, filed on Jan. 6, 2015.

(51) Int. Cl.

| | |
|---|---|
| ***F21V 7/00*** | (2006.01) |
| ***F21K 9/90*** | (2016.01) |
| ***F21V 21/14*** | (2006.01) |
| ***F21S 8/06*** | (2006.01) |
| *F21Y 105/10* | (2016.01) |
| *F21Y 115/10* | (2016.01) |
| *F21Y 113/13* | (2016.01) |

(52) U.S. Cl.

CPC ..... *F21V 7/0016* (2013.01); *F21K 9/90* (2013.01); *F21S 8/06* (2013.01); *F21V 21/14* (2013.01); *F21Y 2105/10* (2016.08); *F21Y 2113/13* (2016.08); *F21Y 2115/10* (2016.08)

(58) Field of Classification Search

CPC ..... F21V 7/0016; F21V 21/14; F21K 9/90; F21S 8/06

See application file for complete search history.

(56) References Cited

U.S. PATENT DOCUMENTS

| | | | | |
|---|---|---|---|---|
| 6,433,483 | B1 * | 8/2002 | Michael | A44C 15/0015 315/200 A |
| 9,661,709 | B2 * | 5/2017 | Krall | H05B 33/0845 |
| 2006/0197456 | A1 | 9/2006 | Cok | |
| 2008/0198578 | A1 * | 8/2008 | Finn | A41B 9/04 362/103 |
| 2009/0116244 | A1 | 5/2009 | Hsiao et al. | |
| 2011/0254470 | A1 | 10/2011 | Penoyer | |

(Continued)

FOREIGN PATENT DOCUMENTS

| | | | |
|---|---|---|---|
| WO | 2013001528 | A1 | 1/2013 |
| WO | 2014201250 | A1 | 12/2014 |

OTHER PUBLICATIONS

International Search Report and Written Opinion issued in a corresponding International Application No. PCT/US2016/012166 dated Sep. 12, 2016.

*Primary Examiner* — Jong-Suk (James) Lee
*Assistant Examiner* — Christopher E Dunay
(74) *Attorney, Agent, or Firm* — Morgan, Lewis & Bockius LLP

(57) ABSTRACT

In accordance with certain embodiments, a substrate having first and second groups of light-emitting elements having different distributions in one or more optical characteristics thereon is deformed such that the first and second groups of light-emitting elements are not simultaneously observable.

13 Claims, 11 Drawing Sheets

(56) References Cited

U.S. PATENT DOCUMENTS

| | | | | |
|---|---|---|---|---|
| 2012/0206914 | A1* | 8/2012 | Oza | F21V 7/00 362/235 |
| 2014/0369038 | A1* | 12/2014 | Tischler | F21V 21/14 362/235 |
| 2015/0241024 | A1* | 8/2015 | Smith | F21K 9/233 362/296.07 |
| 2015/0276189 | A1* | 10/2015 | Palfreyman | F21V 21/14 362/235 |
| 2016/0131331 | A1* | 5/2016 | Parker | G02B 6/0001 362/311.02 |

* cited by examiner

METHODS FOR UNIFORM LED LIGHTING

RELATED APPLICATION

This application claims the benefit of and priority to U.S. Provisional Patent Application No. 62/100,265, filed Jan. 6, 2015, the entire disclosure of which is hereby incorporated herein by reference.

FIELD OF THE INVENTION

In various embodiments, the present invention generally relates to lighting systems incorporating light-emitting diodes (LEDs) and, in particular, to the uniformity of the optical characteristics of such systems.

BACKGROUND

An increasing number of light fixtures utilize LEDs as light sources due to their lower energy consumption, smaller size, improved robustness, and longer operational lifetime relative to conventional filament-based light sources. LEDs have a distribution in optical and electrical characteristics, for example forward voltage, correlated color temperature (CCT), and light output power, which may result in undesirable visible variations in color or intensity within a luminaire using multiple LEDs, or between multiple luminaires. Such variations have been minimized in several ways. One way is the selective use of only some LEDs within a manufacturing distribution (i.e., only LEDs having characteristics falling into a specific narrow range), but the disadvantage of this approach is significantly higher cost. Another method is to provide a mixing chamber or diffusing system that mixes or homogenizes the light. This approach has two disadvantages. First, mixing systems or diffusers require additional volume within the luminaire, increasing the size and cost of the system. Second, such systems typically have increased optical losses in the mixer or diffuser, resulting in reduced efficiency.

Lighting and illumination systems that include LEDs may also suffer from the angularly dependent color non-uniformity of LEDs. In order to mitigate poor angular color uniformity, such illumination systems often require additional elements, such as diffusers, mixing chambers, or the like, to homogenize the color characteristics. Such homogenization often degrades the light-intensity distribution pattern, however, resulting in the need for secondary optics to re-establish the desired light-intensity distribution pattern. The addition of these elements typically requires undesirable additional space or volume, adds cost and expense, and reduces output efficiency.

These limitations related to LED color uniformity are particularly troublesome for luminaires having multiple light-emitting surfaces. For example, some luminaires incorporate both direct and indirect illumination, and these luminaires require separate circuit boards for each illumination direction, with each circuit board requiring a specific set of LEDs to achieve the desired color uniformity and angular color uniformity. These requirements increase the cost and complexity of such systems. Additionally, the multiple boards and necessary interconnection points may decrease reliability. As the number of emitting surfaces or emission directions increases, the cost and complexity of such lighting systems may increase significantly.

Accordingly, there is a need for structures, systems, and procedures enabling LED-based illumination systems to produce uniform color distribution of light in multiple directions and operate with high efficiency while maintaining low cost and relatively small size.

SUMMARY

In accordance with embodiments of the present invention, illumination systems include multiple light-emitting elements (LEEs) that emit electromagnetic radiation within a wavelength regime of interest, for example, visible, ultraviolet (UV) or infrared (IR), mounted on, e.g., a flexible substrate or circuit board. In various embodiments of the invention, at least two groups of LEEs, one or more which have optical (and optionally electrical) characteristics different from the other group(s), are formed on different areas of the flexible substrate. When the flexible substrate is used as an illumination system, or within an illumination system, the sheet is shaped such that the different groups of LEEs emit light in substantially different directions. This approach permits greatly simplified manufacture of illumination systems having multiple emitting surfaces that may emit light in different directions, using a single flexible substrate, which is formed into a two-dimensional or three-dimensional shape to provide the desired light distribution pattern. In various embodiments, each group of LEEs may include only one type of LEEs or may itself include multiple types of LEEs. Embodiments of the invention may incorporate techniques for producing a variety of different light distributions via deformation and/or folding of the flexible substrate as disclosed in U.S. patent application Ser. No. 14/303,197, filed on Jun. 12, 2014, U.S. patent application Ser. No. 14/711,891, filed on May 14, 2015, and U.S. patent application Ser. No. 14/810,630, filed on Jul. 28, 2015, the entire disclosure of each of which is incorporated by reference herein.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of light-emitting elements include solid-state, organic, polymer, phosphor-coated or high-flux LEDs, laser diodes or other similar devices as would be readily understood. The emitted radiation of an LEE may be visible, such as red, blue or green, or invisible, such as infrared or ultraviolet. An LEE may produce radiation of a continuous or discontinuous spread of wavelengths. An LEE may feature a phosphorescent or fluorescent material, also known as a light-conversion material, for converting a portion of its emissions from one set of wavelengths to another. In some embodiments, the light from an LEE includes or consists essentially of a combination of light directly emitted by the LEE and light emitted by an adjacent or surrounding light-conversion material. An LEE may include multiple LEEs, each emitting essentially the same or different wavelengths. In some embodiments, a LEE is an LED that may feature a reflector over all or a portion of its surface upon which electrical contacts are positioned. The reflector may also be formed over all or a portion of the contacts themselves. In some embodiments, the contacts are themselves reflective. Herein the term "reflective" is defined as having a reflectivity greater than 65% for a wavelength of light emitted by the LEE on which the contacts are disposed unless otherwise defined. In some embodiments, an LEE may include or consist essentially of an electronic device or circuit or a passive device or circuit. In some embodiments, an LEE includes or consists essentially of multiple devices, for example an LED and a Zener diode for static-electricity protection. In some embodiments, an LEE may include or consist essentially of a packaged LED, i.e., a bare LED die encased or partially encased in a package. In some embodiments, the packaged LED may also include a light-conversion material. In some embodiments, the light from the LEE may include or consist essentially of light emitted only by the light-conversion material, while in other embodiments the light from the LEE may include or consist essentially of a combination of light emitted from an LED and from the light-conversion material. In some embodiments, the light from the LEE may include or consist essentially of light emitted only by an LED.

In one embodiment, an LEE 130 includes or consists essentially of a bare semiconductor die, while in other embodiments an LEE 130 includes or consists essentially of a packaged LED. In some embodiments, LEE 130 may include or consist essentially of a "white die" that includes an LED that is integrated with a light-conversion material (e.g., a phosphor) before being attached to the light sheet, as described in U.S. patent application Ser. No. 13/748,864, filed Jan. 24, 2013, or U.S. patent application Ser. No. 13/949,543, filed Jul. 24, 2013, the entire disclosure of each of which is incorporated by reference herein.

In an aspect, embodiments of the invention feature a lighting system that includes or consists essentially of a flexible substrate, a first group of light-emitting elements (LEEs) disposed on the substrate, and a second group of LEEs disposed on the substrate. The first group of LEEs has a first distribution of correlated color temperature (CCT), and the second group of LEEs has a second distribution of CCT different from the first distribution of CCT. The substrate is shaped such that the first group of LEEs and the second group of LEEs are not simultaneously observable.

Embodiments of the invention may include one or more of the following in any of a variety of combinations. The substrate may be shaped such that the first group of LEEs is not directly visible by an observer directly observing the second group of LEEs. Light emitted by the first group of LEEs may be emitted in a first direction substantially different from a second direction in which light is emitted by the second group of LEEs. The first group of LEEs may not emit light in the second direction, and/or the second group of LEEs may not emit light in the first direction. The lighting system may include a reflective surface positioned to reflect light emitted by the first group of LEEs, thereby producing reflected light propagating in the second direction. The reflective surface may include or consist essentially of a portion of a structure to which the lighting system is attached (e.g., a ceiling, wall, or other structure). The reflective surface may include or consist essentially of a portion of the lighting system. Both the first and second groups of LEEs may be mounted on the same surface of the substrate. The first group of LEEs may be disposed on a first surface of the substrate, and the second group of LEEs may be disposed on a second side of the substrate opposite the first side of the substrate.

An average CCT of the first group of LEEs may be within four MacAdam ellipses, or within two MacAdam ellipses, of an average CCT of the second group of LEEs. An average CCT of the first group of LEEs may be approximately equal to an average CCT of the second group of LEEs. The first distribution of CCT may be within ten MacAdam ellipses of an average CCT of the first group of LEEs. The second distribution of CCT may be within three MacAdam ellipses of an average CCT of the second group of LEEs. The first distribution of CCT may be within twenty MacAdam ellipses of an average CCT of the first group of LEEs, and the second distribution of CCT may be within four MacAdam ellipses of an average CCT of the second group of LEEs. The first distribution of CCT may be at least three times as large as the second distribution of CCT. The first distribution of CCT may be at least 1.5 times as large as the second distribution of CCT.

The lighting system may include a third group of LEEs having a third distribution of CCT that is substantially the same as the first distribution of CCT. The lighting system may include a third group of LEEs having a third distribution of CCT that is substantially the same as the second distribution of CCT. The substrate may be curved (or otherwise deformed) such that the light emitted by the first group of LEEs is emitted in a substantially different direction than the light emitted by the second group of LEEs. The substrate may be folded such that the light emitted by the first group of LEEs is emitted in a substantially different direction than the light emitted by the second group of LEEs. The lighting system may include an optic disposed over at least a portion of the first group of LEEs and/or the second group of LEEs. The optic may include or consist essentially of a diffuser, a refractive optic, a reflective optic, a total internal reflection optic, and/or a Fresnel optic.

In another aspect, embodiments of the invention feature a lighting system that includes or consists essentially of a flexible substrate, a first group of light-emitting elements (LEEs) disposed on the substrate, and a second group of LEEs disposed on the substrate. The first group of LEEs has a first distribution of at least one optical characteristic. The second group of LEEs has a second distribution of the at least one optical characteristic different from the first distribution of the at least one optical characteristic. The substrate is shaped such that the first group of LEEs and the second group of LEEs are not simultaneously observable.

Embodiments of the invention may include one or more of the following in any of a variety of combinations. The substrate may be shaped such that the first group of LEEs is not directly visible by an observer directly observing the second group of LEEs. The optical characteristic may include, consist essentially of, or consist of correlated color temperature (CCT), color rendering index (CRI), R9, and/or light intensity. Light emitted by the first group of LEEs may be emitted in a first direction substantially different from a second direction in which light is emitted by the second group of LEEs. The first group of LEEs may not emit light in the second direction, and/or the second group of LEEs may not emit light in the first direction. The lighting system may include a reflective surface positioned to reflect light emitted by the first group of LEEs, thereby producing reflected light propagating in the second direction. The reflective surface may include or consist essentially of a portion of a structure to which the lighting system is attached (e.g., a ceiling, wall, or other structure). The reflective surface may include or consist essentially of a portion of the lighting system. Both the first and second groups of LEEs may be mounted on the same surface of the substrate. The first group of LEEs may be disposed on a first surface of the substrate, and the second group of LEEs may be disposed on a second side of the substrate opposite the first side of the substrate.

In yet another aspect, embodiments of the invention feature a method of providing illumination. A substrate is provided. The substrate has disposed thereon first and second groups of light-emitting elements (LEEs). The first and second groups have distributions of an optical characteristic (i) different from each other and (ii) distinguishable by a human observer when viewed directly thereby. The substrate is deformed, without damaging the substrate, into a deformed configuration such that, in the deformed configuration, the first group of LEEs and the second group of LEEs are not simultaneously observable.

Embodiments of the invention may include one or more of the following in any of a variety of combinations. In the deformed configuration, the second group may provide direct illumination and the first group may provide only indirect illumination. The substrate may be mounted or affixed in a room (e.g., on a wall or a ceiling) or other location such that the direct and indirect illumination are provided to an observer in the typical course of usage of the substrate as a lighting apparatus. In the deformed configuration, the first group of LEEs may not be directly visible by an observer directly observing the second group of LEEs. The optical characteristic may include, consist essentially of, or consist of correlated color temperature (CCT), color rendering index (CRI), R9, and/or light intensity. A distribution of the optical characteristic of the first group may be less than three times as large as the distribution of the optical characteristic of the second group. A distribution of the optical characteristic of the first group may be less than 1.5 times as large as the distribution of the optical characteristic of the second group. A distribution of the optical characteristic of the first group may be between 1.5 times and 10 times the distribution of the optical characteristic of the second group. An average of the optical characteristic of the first group may be approximately equal to an average of the optical characteristic of the second group. In the deformed configuration, light emitted by the first group may be emitted in a first direction substantially different from a second direction in which light is emitted by the second group. A portion of the light emitted by the second group may be reflected, thereby producing reflected light propagating in the first direction. A portion of the light emitted by the first group may be reflected, thereby producing reflected light propagating in the second direction. The substrate may be flexible. An optic may be disposed over at least a portion of the first group and/or the second group. The optic may include or consist essentially of a diffuser, a refractive optic, a reflective optic, a total internal reflection optic, and/or a Fresnel optic.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. As used herein, the terms "about," "approximately," and "substantially" mean±10%, and in some embodiments, ±5%. The term "consists essentially of" means excluding other materials that contribute to function, unless otherwise defined herein. Nonetheless, such other materials may be present, collectively or individually, in trace amounts.

Herein, two components such as light-emitting elements and/or optical elements being "aligned" or "associated" with each other may refer to such components being mechanically and/or optically aligned. By "mechanically aligned" is meant coaxial or situated along a parallel axis. By "optically aligned" is meant that at least some light (or other electromagnetic signal) emitted by or passing through one component passes through and/or is emitted by the other. Substrates, light sheets, components, and/or portions thereof described as "reflective" may be specularly reflective or diffusively reflective unless otherwise indicated.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
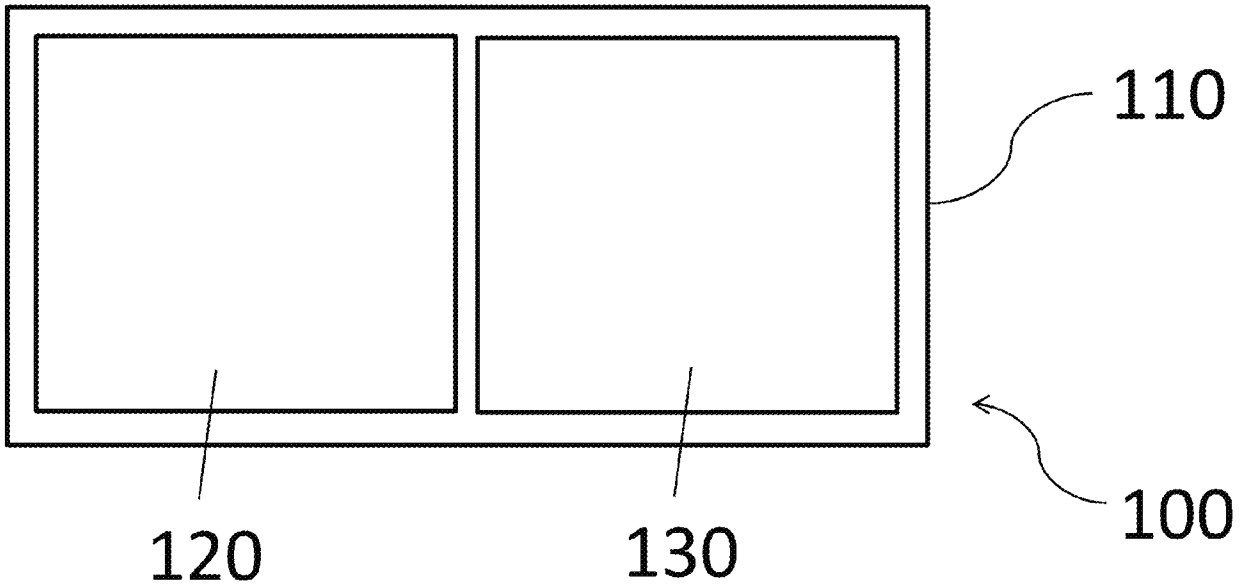
FIGS. 1A and 1B are schematic illustrations of lighting systems in accordance with various embodiments of the invention.
Figure 1B:
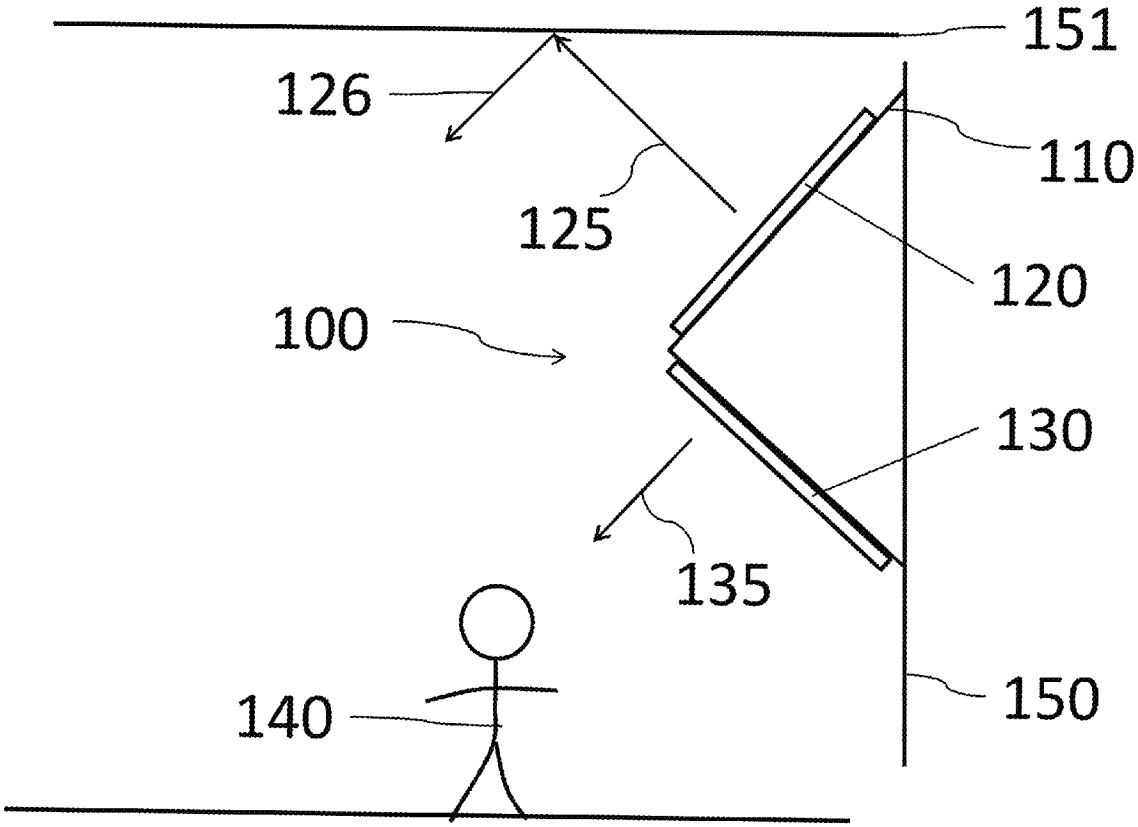

FIGS. 1A-1B depict an exemplary illumination system in a flat and shaped configuration respectively, in accordance with embodiments of the present invention, although alternative systems with similar functionality are also within the scope of the present invention. FIG. 1A depicts, in a flat configuration, a luminaire (or "lighting system") 100 that includes or consists essentially of a first group 120 of LEEs and a second group 130 of LEEs formed over a flexible substrate 110, where the LEEs in group 120 are different from those in group 130. Note that the individual LEEs are not shown in FIG. 1A or 1B for clarity. FIG. 1B shows the luminaire 100 of FIG. 1A shaped such that the LEEs of first group 120 emit light in a different or substantially different direction than the LEEs of second group 130. In this example, substrate 110 is folded at about 90° in the region between group 120 and group 130; however, this is not a limitation of the present invention, and in other embodiments the structure may have other shapes, as described herein. Lighting system 100 is shown as being mounted on a vertical surface 150, which may be a wall, pole, building, or other structure; however, this is not a limitation of the present invention, and in other embodiments lighting system 100 may be mounted in any orientation. As shown in FIG. 1B, light 135 emitted from group 130 is viewable and viewed directly by a viewer 140, while light 125 emitted from group 120 is directed upwards and is not directly viewable by viewer 140. In this example, light from group 120 may reflect off of, for example, a surface 151 and be viewed indirectly by the viewer 140 as indirect light 126. Herein, "indirectly viewed" means that the illumination source is not directly, in a line of sight, visible or viewable by a viewer (or at a particular vantage point). In other words, light 135 emitted by group 130 provides substantially direct illumination while light 125 emitted by group 120 provides substantially indirect illumination. As utilized herein, the term "indirect illumination" refers to light that is only indirectly viewed. In various embodiments of the present invention, the LEEs in group 120 may have a larger distribution in CCT or other optical characteristics than the LEEs in group 130 because the larger variation in group 120 is not directly visible to viewer 140 and because the individual variations in CCT of the LEEs are at least partially homogenized by mixing of the light and reflection from surface 151. For example, in various embodiments the distribution of one or more optical characteristics of the LEEs in group 120 may be about five times as large, or about three times as large, or about 1.5 times as large as the distribution of the optical characteristic(s) of the LEEs in group 130. In various embodiments, the distribution of one or more optical characteristics of the LEEs in group 120 may be between about 1.5 times and about ten times as large as the distribution of the optical characteristic(s) of the LEEs in group 130.

Flexible substrate 110 may include or consist essentially of a semicrystalline or amorphous material, e.g., polyethylene naphthalate (PEN), polyethylene terephthalate (PET), polycarbonate, polyethersulfone, polyester, polyimide, polyethylene, and/or paper. In some embodiments of the present invention substrate 110 may include multiple layers. Depending upon the desired application for which embodiments of the invention are utilized, substrate 110 may be substantially optically transparent, translucent, or opaque. For example, substrate 110 may exhibit a transmittance or a reflectivity greater than 70% for optical wavelengths ranging between approximately 400 nm and approximately 700 nm. In some embodiments, substrate 110 may exhibit a transmittance or a reflectivity of greater than 70% for one or more wavelengths emitted by LEEs in groups 120 and/or 130. Substrate 110 may also be substantially insulating, and may have an electrical resistivity greater than approximately 100 ohm-cm, greater than approximately $1\times10^6$ ohm-cm, or even greater than approximately $1\times10^{10}$ ohm-cm. In some embodiments, substrate 110 may have a thickness in the range of about 10 μm to about 500 μm.

In various embodiments, the substrate 110 is "flexible" in the sense of being pliant in response to a force such that the substrate may be easily bent or otherwise deformed without damage thereto. The substrate 110 may also be resilient, i.e., tending to elastically resume an original configuration upon removal of the force. In some embodiments, flexible substrate 110 is configurable to a radius of curvature of about 1 m or less, or about 0.5 m or less, or even about 0.1 m or less. In some embodiments, flexible substrate 110 has a Young's Modulus less than about 100 $N/m^2$, less than about 50 $N/m^2$, or even less than about 10 $N/m^2$. In some embodiments, flexible substrate 110 has a Shore A hardness value less than about 100; a Shore D hardness less than about 100; and/or a Rockwell hardness less than about 150.

Figure 2A:
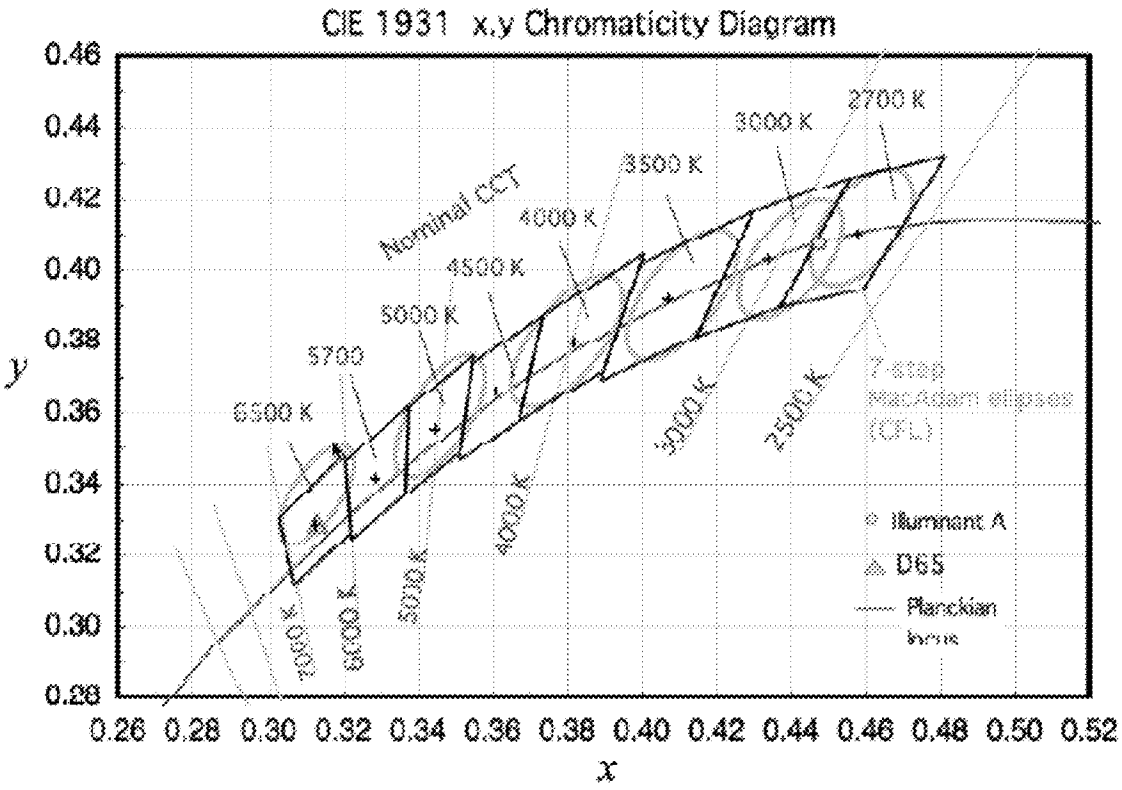
FIGS. 2A-2C illustrate techniques for binning LEDs in accordance with various embodiments of the invention.
Figure 2B:
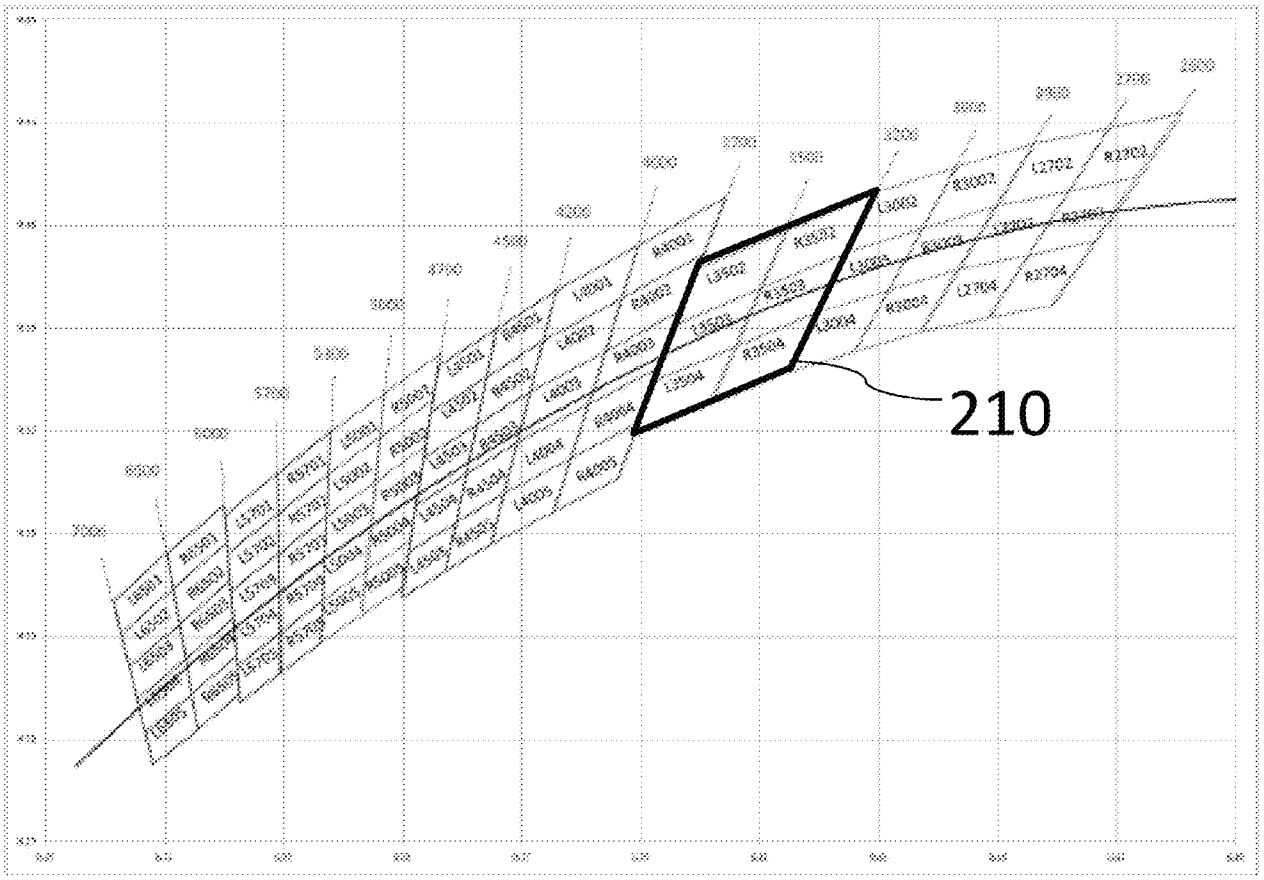

In various embodiments, the LEEs may include or consist essentially of light-emitting diodes (LEDs). While different manufacturers have different ways of categorizing LED color uniformity, for example CCT, many of these approaches are based on the ANSI bin structure described in ANSI/NEMA/ANSLG C78.377-2008, the entirety of which is incorporated herein. FIG. 2A shows a version of the ANSI bins overlaid on the CIE 1931 x,y chromaticity chart. As may be seen, this diagram defines eight bins having color temperatures ranging from about 2700K to about 6500K. Each bin encompasses a seven-step MacAdam ellipse, where, as known to those of skill in the art, one MacAdam ellipse is defined as the variation in color that is just perceptible to a human viewer. For many applications, a seven-step variation is too large, and many LED suppliers divide each quadrangle into nine or 16 sub-bins to permit finer control of CCT. FIG. 2B shows an example of a bin structure having smaller bins than the standard ANSI bins. For example, the 3500K ANSI quadrangle, identified as 210 in FIG. 2B, has been divided into six sub-bins.

One approach to achieving high CCT uniformity in LED lighting systems is to only use LEDs having optical characteristics falling into only a single sub-bin. However, the LED manufacturing process has a relatively wide distribution, which makes this approach prohibitively expensive for many applications. Alternately, one may mix LEDs from different bins, with the cost decreasing as more bins, and thus larger portions of the manufacturing distribution, are utilized.

Figure 2C:
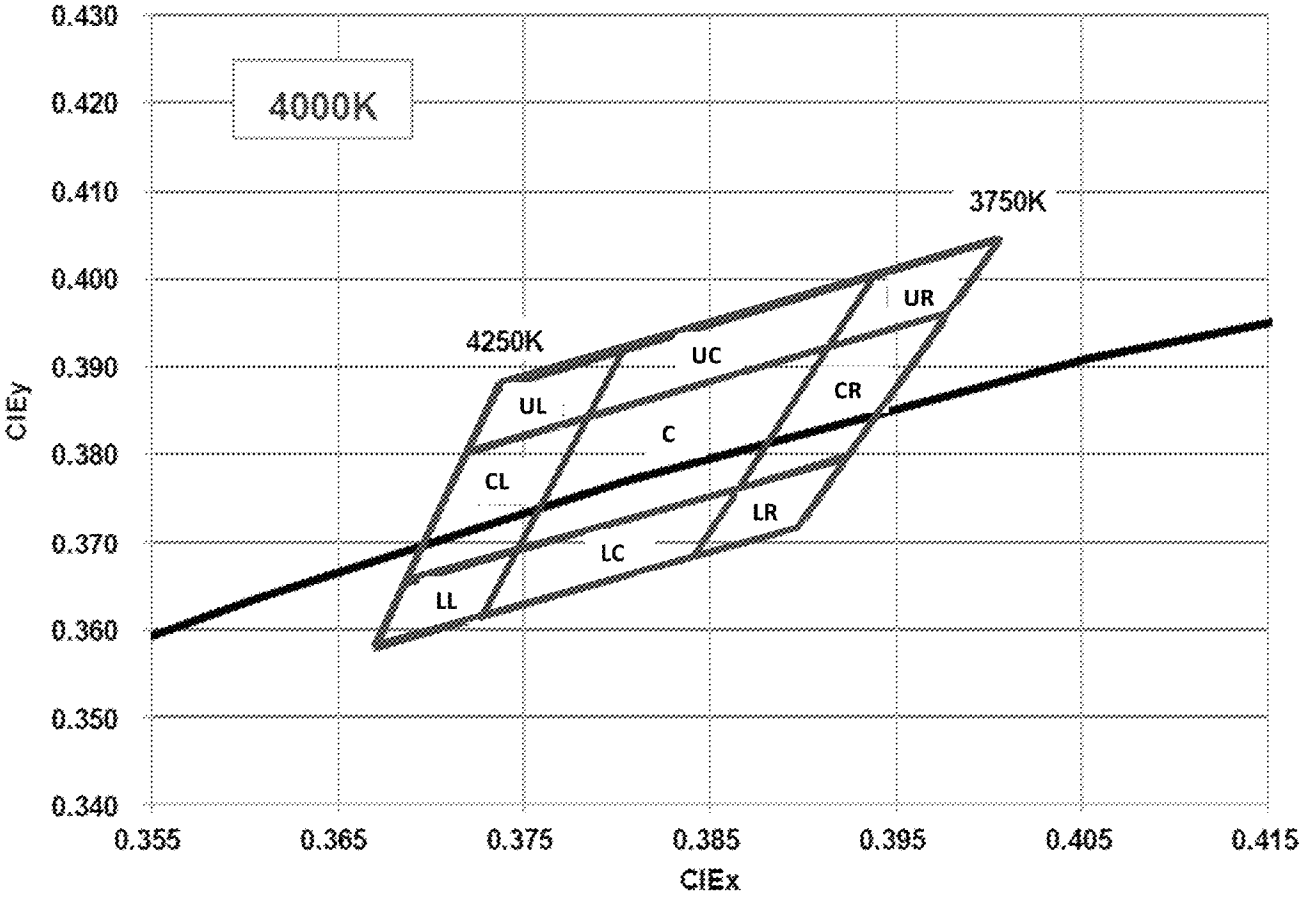

FIG. 2C shows one example of a sub-bin configuration for a nominal 4000K LED manufacturing distribution. As shown in FIG. 2C, the color temperature ranges from about 3750K to about 4250K over the entire ANSI bin, a range of about 500K. Dividing the ANSI bin into nine sub-bins permits finer gradation of the LED CCT. The bins are identified as Upper Left (UL), Center Left (CL), Lower Left (LL), Upper Center (UC), Center (C), Lower Center (LC), Upper Right (UR), Center Right (CR), and Lower Right (LR). As discussed herein, one approach may be to simply use LEDs from the center bin C. However, as also described herein, the use of a single sub-bin is often too expensive for many applications. Another approach is to mix LEDs from different sub-bins, for example to use LEDs from the center bins and various bin pairs, for example UL/LR, CL/CR and/or LL/UR. One aspect of the use of such bin pairs opposite each other across the center bin is that the average color temperature of the LEDs from the two bins in the pair is substantially the same as the average color temperature of the center bin. Thus, a lighting system having an average CCT equal to that of the center bin may be produced with different configurations of bin pairs, permitting the use of a larger portion of the manufacturing distribution. As understood by those skilled in the art, the bin structures shown in FIGS. 2B and 2C represent one approach to sub-binning, but others may be utilized, and various approaches to using LEDs from different sub-bins may also be utilized. None of these are limitations of the present invention.

Referring back to lighting system 100 of FIGS. 1A and 1B, in various embodiments group 120 may include or consist essentially of LEDs from more bins or a wider range of bins than LEDs in group 130. For example, in some embodiments group 130 may include LEDs from only one bin, for example a center bin such as C and group 120 may include LEDs from more than one bin, for example bin pairs UL/LR, CL/CR, and/or LL/UR. In other embodiments, group 120 may include LEDs from all bins or from other combinations of bins.

Figure 3A:
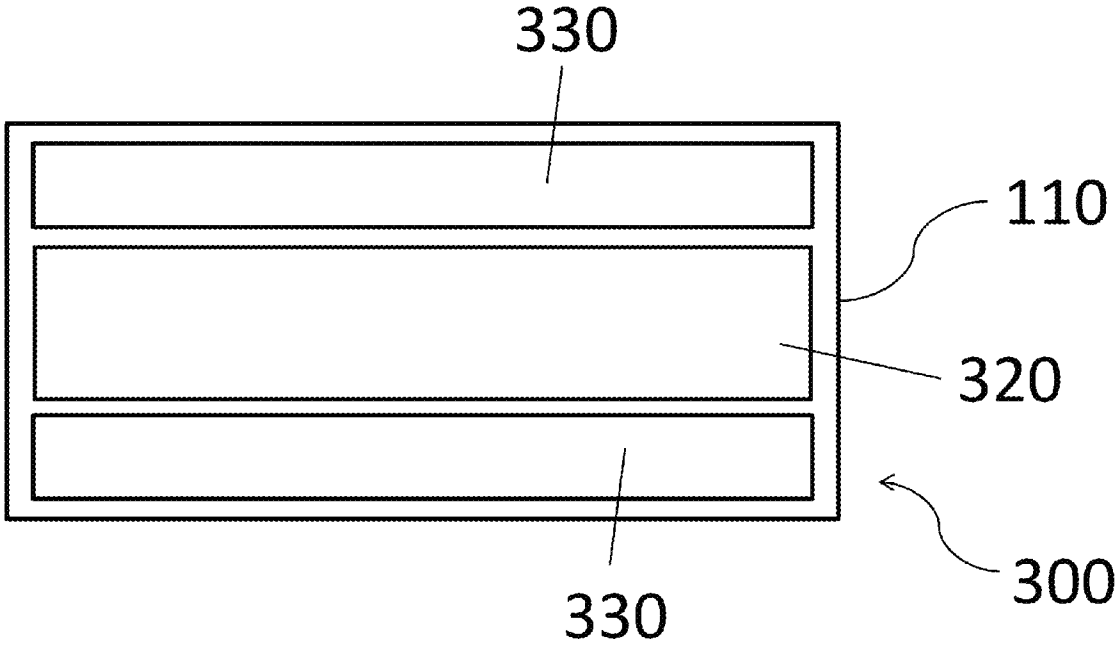
FIGS. 3A-3D, 4A, and 4B are schematic illustrations of lighting systems in accordance with various embodiments of the invention.
Figure 3B:
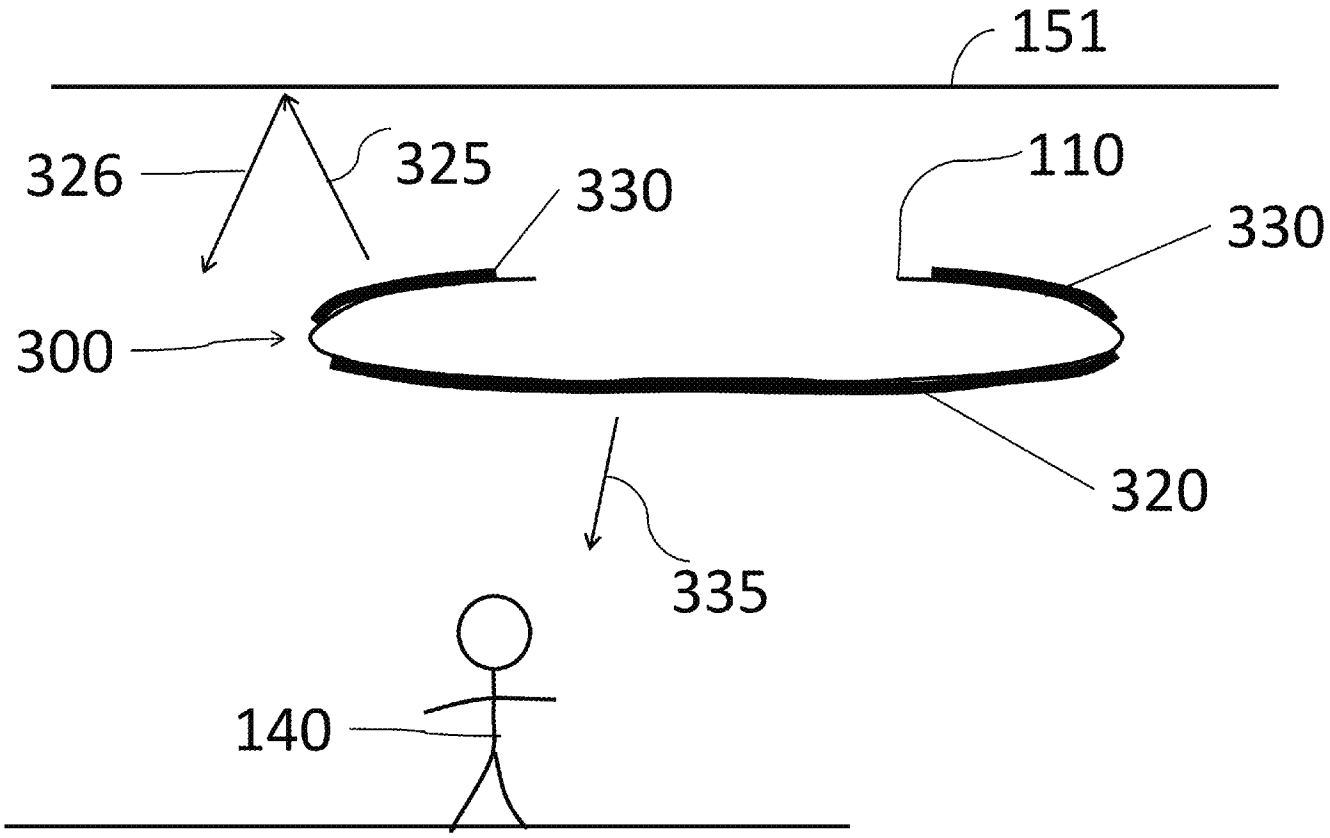

FIG. 3A depicts, in a flat configuration, a luminaire (or "lighting system") 300 that includes or consists essentially of a first group 320 of LEEs and two second groups 330 of LEEs disposed over flexible substrate 110, where the LEEs in group 320 are different from those in groups 330. That is, the LEEs in group 320 have different optical and/or electrical characteristics than the LEEs in groups 330. Note that the individual LEEs are not shown in FIG. 3A or 3B for clarity. FIG. 3B shows the structure of FIG. 3A shaped such that the LEEs of first group 320 emit light in a different or substantially different direction than the LEEs of the two second groups 330. In this example, substrate 110 is curved such that portions of substrate 110 on which groups 330 are disposed are pointing in one direction (in this example substantially up) and portions of substrate 110 on which group 320 are disposed are pointing in a different direction (in this example substantially down). In this example, light 335 from group 320 provides substantially direct illumination while light 325 emitted from groups 330 provides substantially indirect illumination. For example, light 325 emitted by groups 330 may be in part reflected from surface 151, resulting in light 326. In various embodiments, the light emitted from groups 330 providing indirect illumination may have a larger CCT distribution and/or other optical characteristics, for example color rendering index (CRI), R9, light intensity or the like, than light emitted from group 320 providing direct illumination. In various embodiments, the light emitted from each group of LEEs may have the same or substantially the same average CCT but may have a different distribution of CCTs, for example the range of CCT values in each group may be different or the distribution of CCTs in each group may be different. For example, in some embodiments of the present invention, the CCT range may be larger in a group providing indirect illumination than the CCT range in a group providing direct illumination.

In some embodiments of the present invention, group 320 may include LEEs from only one bin, for example a center bin, for example bin C of FIG. 2C, while groups 330 may include LEEs from more than one bin, for example bins pairs UL/LR, CL/CR, and/or LL/UR. In other embodiments, group 330 may include LEEs from all bins or form other combinations of bins. In some embodiments, one or more groups that include two bin pairs may have the LEEs from each bin arranged in various configurations, for example in a random pattern, in lines, in a checkerboard pattern or the like.

Figure 3C:
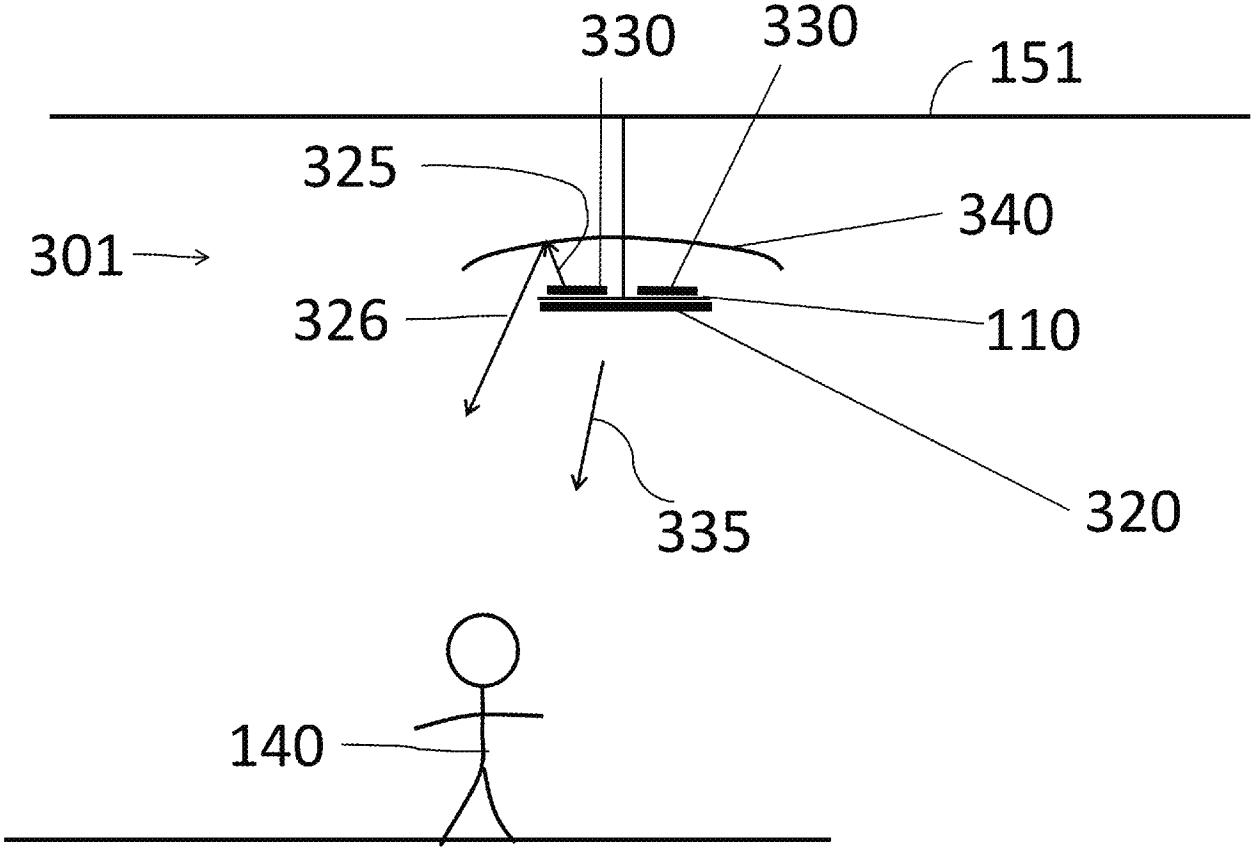

FIG. 3C shows a lighting system 301 in accordance with various embodiments of the present invention that includes flexible substrate 110 over which are disposed a first group 320 of LEEs and two second groups of LEEs 330, where groups 320 and 330 are disposed on opposite sides of substrate 110. While FIG. 3C shows LEEs on both sides of substrate 110, this is not a limitation of the present invention, and in other embodiments the LEEs from the different groups may all be on one side of substrate 110 and substrate 110 may be folded or curved, for example as shown in FIG. 3B, to provide light in more than one direction. Lighting system 301 also incorporates an optional reflector 340. In various embodiments, lighting system 301 may not include reflector 340 (or any other reflector), in which case light 325 emitted from groups 330 may be reflected from surface 151 rather than reflector 340. As discussed with respect to lighting system 300 of FIG. 3B, light 335 from group 320 provides substantially direct illumination while light 325 emitted from groups 330 provides substantially indirect illumination. Light 325 emitted by groups 330 is at least in part reflected from reflector 340, resulting in light 326. In various embodiments, the light emitted from groups 330 providing indirect illumination may have a larger CCT distribution and/or other optical characteristics, for example color rendering index (CRI), R9, light intensity or the like, than light emitted from group 320 providing direct illumination. In various embodiments, the light emitted from each group of LEEs may have the same or substantially the same average CCT but may have a different distribution of CCTs, for example the range of CCT values in each group may be different or the distribution of CCTs in each group may be different. For example, in some embodiments of the present invention, the CCT range may be larger in the group providing indirect illumination than the CCT range in the group providing direct illumination.

Figure 3D:
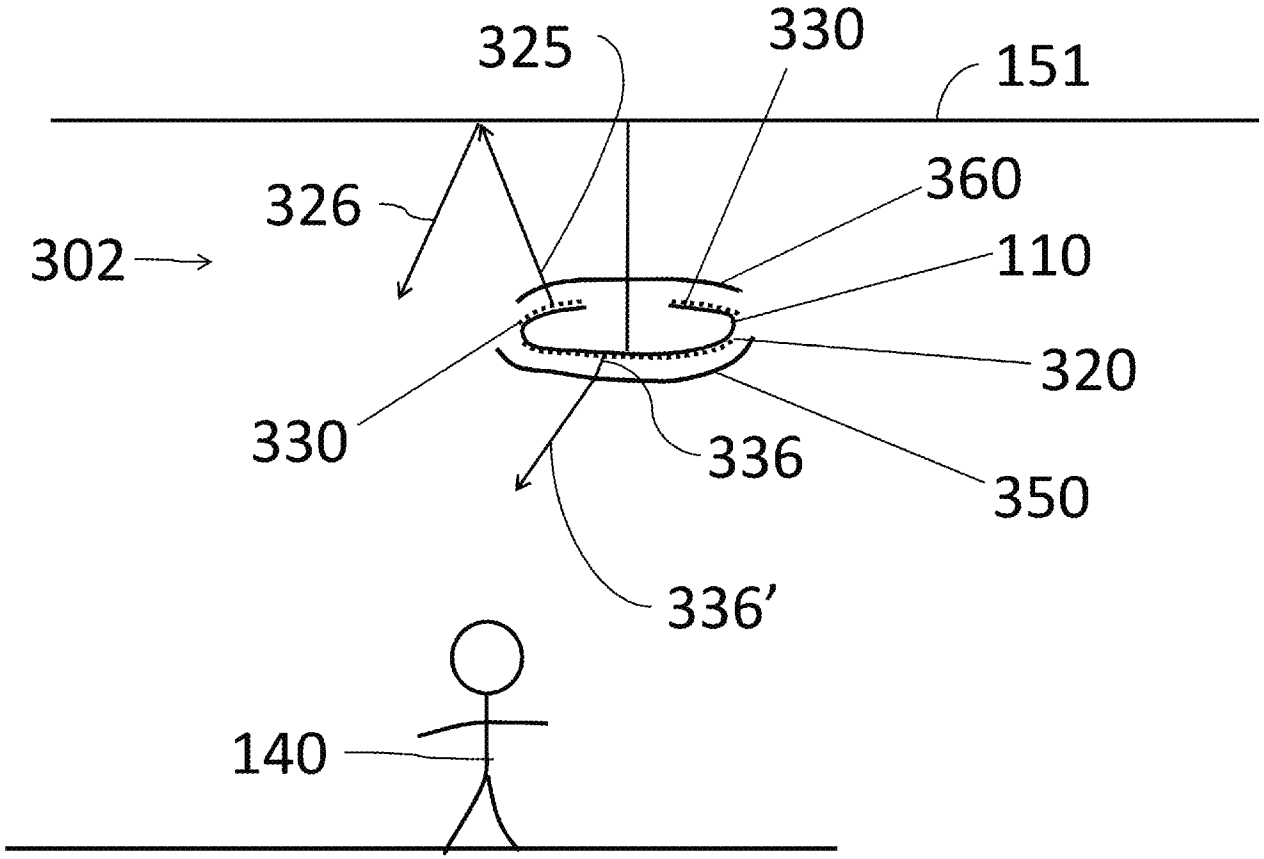

FIG. 3D shows an embodiment of a lighting system of the present invention similar to that of FIG. 3C; however, the structure of FIG. 3D includes optics 350 and 360. In various embodiments, optics 350 and 360 may each include or consist essentially of a diffuser to homogenize the light, or an optic to change the appearance of the light or to change the direction or spatial light distribution pattern. In FIG. 3D, optic 360 is shown schematically as a diffuser, while optic 350 is shown as an optical element that changes the spatial light intensity distribution, as shown by the change in the direction of light ray 336 to light ray 336' after exiting optic 350. The configuration of the optics shown in FIG. 3D is not limiting, and in various embodiments different optics with different characteristics may be used in conjunction with different LEE groups, or one or more LEE groups may not utilize an optic. In various embodiments, optic 350 and 360 may include or consist essentially of a diffuser, a refractive optic, a reflective optic, a total internal reflection optic, a Fresnel optic, or any other optic. The specific configuration or type of the optic is not a limitation of the present invention.

Figure 4A:
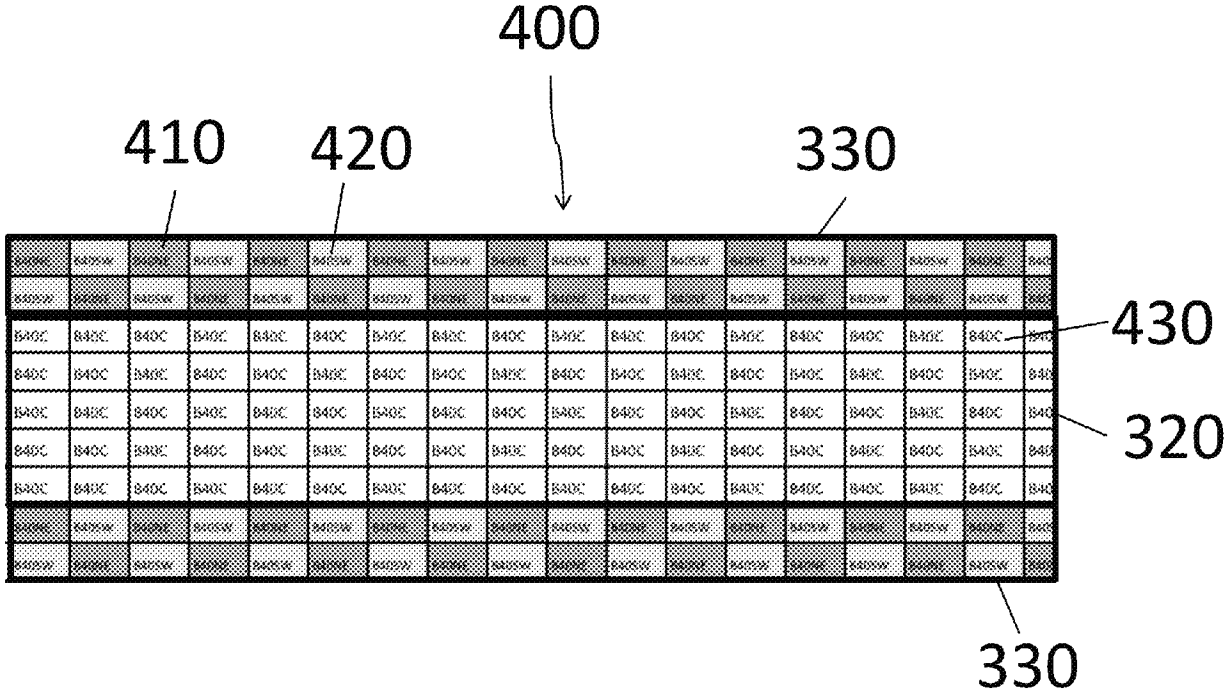

FIG. 4A shows one embodiment of a lighting system 400 of the present invention similar to that of FIG. 3A; however, FIG. 4A schematically shows individual LEEs. In this example, group 320 includes a single bin of LEEs 430, while groups 330 include pairs of LEEs 410 and 420 arranged in a checkerboard pattern. In various, embodiments group 330 may include bin diagonal bin pairs (i.e., where bin pairs are pairs of bins spaced away from a center bin in opposite directions by approximately the same distance), for example bins UL/LR and/or LL/UR as shown in FIG. 2C.

Figure 4B:
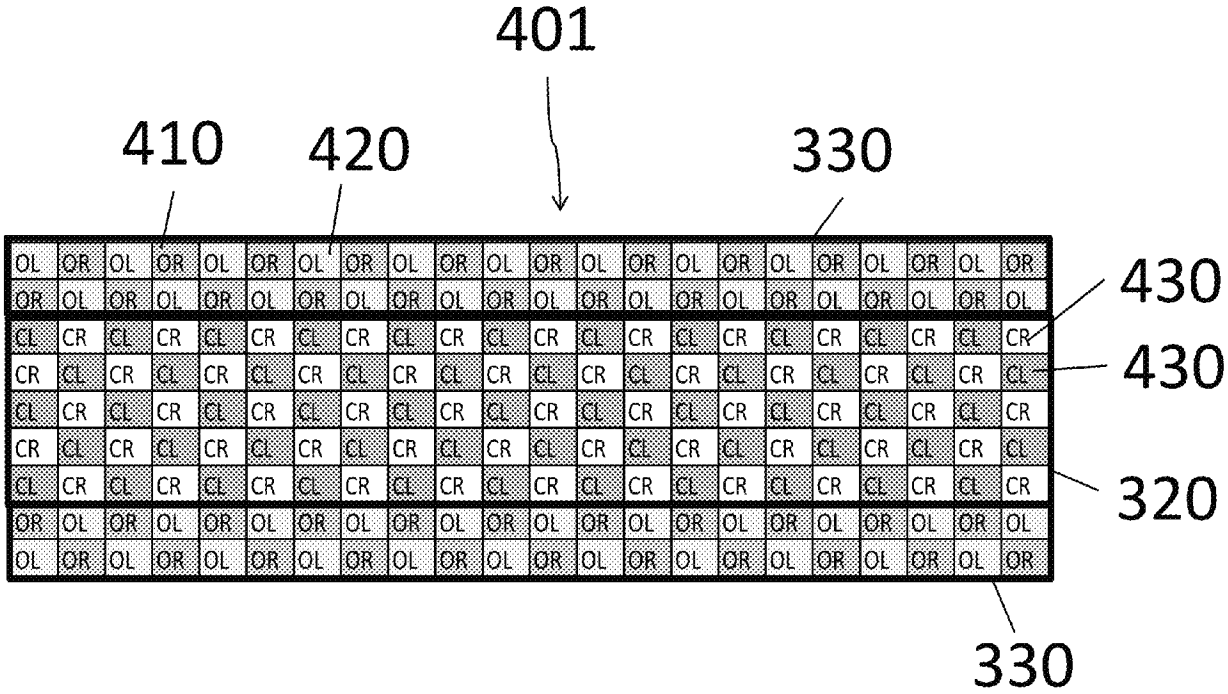

FIG. 4B shows one embodiment of a lighting system of the present invention similar to that shown of FIG. 4A; however, lighting system 401 of FIG. 4B includes multiple bins in both groups 320 and 330. In this example, group 330 includes diagonal (or outer) bin pairs arranged in a checkerboard pattern, for example where OL and OR represent the upper right and lower left bins respectively or the upper left and lower right bins respectively (for example UL/LR or LL/UR in FIG. 2C), and group 320 includes left and right bin pairs arranged in a checkerboard pattern, for example where CR and CL represent the bins to the left and right of the center bin, for example CL/CR of FIG. 2C. In various embodiments, the center bin C may also be included in one or more of the groups of LEEs, or a group may include only bin C.

While the examples discussed herein have mainly had each group of LEEs taken from a bin pair, this is not a limitation of the present invention, and in other embodiments other groupings of bins may be utilized. For example, one LEE group may include LEEs from the UL, UR, LL and LR bins, such that the average CCT of that group is the same as or substantially the same as that of the other group or groups of LEEs or of the desired CCT value. In the examples discussed herein in which a group of LEEs includes two bins, the number of LEEs from each bin has been the same or substantially the same; however, this is not a limitation of the present invention, and in other embodiments the number of LEEs from each bin (in various embodiments there may be two or more bins) may be different. While the examples discussed with respect to FIGS. 4A and 4B show LEEs arranged in a checkerboard pattern, this is not a limitation of the present invention, and in other embodiments LEEs may be arranged in rows, blocks, randomly, or in other patterns.

In various embodiments of the present invention the distribution of the CCT values of each LEE in a group of LEEs is within about 4 MacAdam ellipses, or within about 3 MacAdam ellipses, or within about 2 MacAdam ellipses, or within about 1 MacAdam ellipse of the average CCT value of that group of LEEs. In various embodiments of the present invention, the distribution of the CCT values of each LEE in a group of LEEs that provide substantially direct illumination is within about 4 MacAdam ellipses, or within about 3 MacAdam ellipses, or within about 2 MacAdam ellipses, or within about 1 MacAdam ellipse of the average CCT value of that group of LEEs. In various embodiments of the present invention, the average CCT of the first group of LEEs is approximately equal to an average CCT of the second group of LEEs, where one of the groups is utilized to provide direct illumination and the other group is utilized to provide indirect illumination. In various embodiments of the present invention, the distribution of the CCT values of each LEE in a group of LEEs that provide substantially indirect illumination is within about 20 MacAdam ellipses, or within about 10 MacAdam ellipses, or within about 7 MacAdam ellipses, or within about 5 MacAdam ellipses, or within about 3 MacAdam ellipses of the average CCT value of that group of LEEs. In various embodiments of the invention, an exemplary system may have two groups of LEEs, a first group providing direct illumination with the CCT distribution of individual LEEs within that group less than about 4 MacAdam ellipses, and a second group providing indirect illumination with the CCT distribution of individual LEEs within that group less than about 10 MacAdam ellipses. In various embodiments of the present invention, the CCT distribution of individual LEEs within a group that provides indirect illumination may be about 3 times or about 2 times or about 1.5 times as large as the CCT distribution of individual LEEs within a group that provides direct illumination.

In various embodiments, the average CCT value of each group of LEEs is the same within about 4 MacAdam ellipses, or about 3 MacAdam ellipses or about 2 MacAdam ellipses or about 1 MacAdam ellipse.

While the examples discussed with reference to lighting systems of FIG. 3A-3D have grouped the LEEs by bins as defined, for example in FIG. 2C, this is not a limitation of the present invention, and in other embodiments groups of LEEs may be composed of LEEs from various portions of the manufacturing distribution using other bin or categorization schemes, as long as the average CCT (or other optical parameter) of each group is the same as or substantially the same as that of the other group or of a target value. In various embodiments of the present invention, each group of LEEs is composed of LEEs selected from the entire distribution, such that within each group, the average CCT (or other optical parameter) is the same as or substantially the same as that of the other groups of LEEs or the desired CCT (or other optical parameter). In various embodiments, the desired CCT may be the center of the center bin; however, this is not a limitation of the present invention, and in other embodiments the desired CCT and thus the target for the average values of the different groups may be any color point, for example the center of the center bin, a color coordinate within the center bin, or any arbitrary color coordinate.

In various embodiments of the present invention, the light emitted by the different groups may have a different average CCT and/or other optical characteristics, for example color rendering index (CRI), R9, light intensity, or the like. For example, in some embodiments of the present invention, the CCT of a group providing direct illumination may have a lower CCT than a group providing indirect illumination, or the CCT of a group providing direct illumination may have a higher CCT than a group providing indirect illumination. In various embodiments of the present invention, the CRI and/or R9 of a group providing direct illumination may have a higher CRI and/or R9 than a group providing indirect illumination, or the CRI and/or R9 of a group providing direct illumination may have a lower CRI and/or R9 than a group providing indirect illumination. In various embodiments of the present invention, the light intensity of a group providing direct illumination may be lower than that of a group providing indirect illumination, or the light intensity of a group providing direct illumination may be higher than that of a group providing indirect illumination.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of providing illumination, the method comprising:

providing a substrate having disposed thereon first and second groups of light-emitting elements (LEEs), the first and second groups having distributions of an optical characteristic (i) different from each other when all LEEs of each group are illuminated and (ii) distinguishable by a human observer when all of the LEEs of each group are (a) illuminated and (b) viewed directly by the human observer; and thereafter, deforming without damaging the substrate into a deformed configuration such that, in the deformed configuration, tithe first group of LEEs and the second group of LEEs are not simultaneously observable, (ii) the second group of LEEs is directly observable by the human observer, thereby providing direct illumination, (iii) none of the LEEs of the first group of LEEs are directly visible by the human observer, whereby the first group of LEEs provides only indirect illumination, and (iv) all of the LEEs in the second group of LEEs emit white light.

2. The method of claim 1, wherein the optical characteristic comprises at least one of correlated color temperature (CCT), color rendering index (CRI), R9, or light intensity.

3. The method of claim 1, wherein a distribution of the optical characteristic of the first group is less than three times as large as the distribution of the optical characteristic of the second group.

4. The method of claim 1, wherein a distribution of the optical characteristic of the first group is less than 1.5 times as large as the distribution of the optical characteristic of the second group.

5. The method of claim 1, wherein a distribution of the optical characteristic of the first group is between 1.5 times and 10 times the distribution of the optical characteristic of the second group.

6. The method of claim 1, wherein an average of the optical characteristic of the first group is approximately equal to an average of the optical characteristic of the second group.

7. The method of claim 1, wherein, in the deformed configuration, light emitted by the first group is emitted in a first direction substantially different from a second direction in which light is emitted by the second group, and further comprising reflecting a portion of the light emitted by the second group, thereby producing reflected light propagating in the first direction.

8. The method of claim 1, wherein the substrate is flexible.

9. The method of claim 1, further comprising disposing an optic over at least a portion of at least one of the first group or the second group.

10. The method of claim 9, wherein the optic comprises at least one of a diffuser, a refractive optic, a reflective optic, a total internal reflection optic, or a Fresnel optic.

11. The method of claim 1, wherein all LEEs on the substrate are within the first group of LEEs or the second group of LEEs.

12. The method of claim 1, wherein, in the deformed configuration, the first and second groups of LEEs emit light in substantially opposite directions.

13. The method of claim 1, further comprising mounting the substrate in the deformed configuration above the human observer, the direct illumination from the second group of LEEs being emitted downward toward the human observer, and the indirect illumination from the first group of LEEs being emitted upward away from the human observer.

* * * * *